US007044900B2

(12) United States Patent
Leftheriotis

(10) Patent No.: US 7,044,900 B2
(45) Date of Patent: May 16, 2006

(54) EXERCISE APPARATUS

(76) Inventor: Charalabos Leftheriotis, Elm Hotel, Room 110, 1800 Berlin Turnpike, Wethersfield, CT (US) 06109

( * ) Notice: Subject to any disclaimer, the term of this patent is extended or adjusted under 35 U.S.C. 154(b) by 503 days.

(21) Appl. No.: 10/150,635

(22) Filed: May 17, 2002

(65) Prior Publication Data

US 2003/0216232 A1 Nov. 20, 2003

(51) Int. Cl.
*A63B 26/00* (2006.01)
*A63B 71/00* (2006.01)

(52) U.S. Cl. ..... 482/142; 482/148; 482/129; 482/130; 482/133; 482/134

(58) Field of Classification Search ..... 482/27, 482/28, 29, 30, 77, 142, 148, 129, 130, 133, 482/134
See application file for complete search history.

(56) References Cited

U.S. PATENT DOCUMENTS

| | | | | | |
|---|---|---|---|---|---|
| 406,328 | A | * | 7/1889 | Wenker | 482/77 |
| 1,587,545 | A | | 6/1926 | Moorhouse | |
| 2,172,000 | A | * | 9/1939 | Wenker | 482/77 |
| 2,723,856 | A | | 11/1955 | Thomson | 272/58 |
| 3,401,910 | A | * | 9/1968 | Rude | 482/30 |
| 3,424,005 | A | | 1/1969 | Brown | 73/379 |
| 3,701,529 | A | | 10/1972 | Kruthaupt | 272/83 R |
| 4,198,045 | A | | 4/1980 | Miller | 272/142 |
| 4,405,129 | A | | 9/1983 | Stuckey | 272/130 |
| 4,846,458 | A | | 7/1989 | Potts | 272/65 |
| 5,141,480 | A | | 8/1992 | Lennox | 482/104 |
| 5,176,601 | A | | 1/1993 | Reynolds | 482/130 |
| RE34,212 | E | | 4/1993 | Potts | 482/26 |
| 5,304,109 | A | | 4/1994 | Shockley | 482/142 |
| 6,280,361 | B1 | * | 8/2001 | Harvey et al. | 482/8 |
| 6,689,026 | B1 | * | 2/2004 | Almada | 482/140 |
| 6,699,162 | B1 | * | 3/2004 | Chen | 482/140 |

* cited by examiner

*Primary Examiner*—Justine R. Yu
*Assistant Examiner*—L. Amerson
(74) *Attorney, Agent, or Firm*—McCormick Paulding & Huber LLP

(57) ABSTRACT

An exercise apparatus comprising a frame, and at least one elongated sheet of flexible material has a first end coupled to the frame and has a second free end positioned frontwardly relative to the frame. The sheet of flexible material has an upwardly facing support surface, and the sheet of flexible material has a predetermined stiffness for supporting substantially the entire weight of an exerciser of the apparatus. At least one support assembly is mounted to the frame and generally overhangs the support surface of the sheet of flexible material for further supporting the exerciser upon pushing downwardly against the sheet of flexible material and thereby moving the free end of the sheet of flexible material downwardly, and for supporting the exerciser upon pulling upwardly to release the downward force against the sheet of material and thereby permitting the free end of the sheet of flexible material to move upwardly.

14 Claims, 2 Drawing Sheets

EXERCISE APPARATUS

FIELD OF THE INVENTION

The present invention relates to exercise apparatus, and more particularly, to exercise apparatus which isometrically stress and build muscles.

BACKGROUND OF THE INVENTION

Exercise apparatus often include movable members which generate a substantial opposing force in response to being moved by an exerciser for strengthening muscles and/or increasing muscle tone. For example, the weight of bar bells provide a generally constant opposing force during the exerciser's range of movement. Other apparatus partially generate, independent of exerciser exertion, a repetitive movement for matching or aiding the movement of the exerciser to partially reduce the opposing force. For example, U.S. Re. Pat. No. 34,212 to Potts shows an upper body exercise apparatus having a vertically movable exerciser support platform in combination with chin and dip bars. Pneumatic pistons driven by an electric motor automatically raise and lower the platform for aiding the exerciser. The above apparatus, which can either provide a constant opposing force or generate independent forces, can possibly contribute to injury to the exerciser if misused.

In response to the foregoing, it is an object of the present invention to overcome the drawbacks and disadvantages of prior art exercise apparatus.

SUMMARY OF THE INVENTION

The present invention is directed to an exercise apparatus comprising a frame. At least one elongated sheet of flexible material has a first end coupled to the frame and has a second free end positioned frontwardly relative to the frame. The sheet of flexible material has an upwardly facing support surface, and the sheet of flexible material has a predetermined stiffness for supporting substantially the entire weight of an exerciser of the apparatus. At least one support assembly is mounted to an upper portion of the frame and generally overhangs the support surface of the sheet of flexible material for further supporting the exerciser upon pushing downwardly against the sheet of flexible material and thereby moving the second free end of the sheet of flexible material downwardly, and for supporting the exerciser upon pulling upwardly away from the sheet of flexible material to release the downward force against the sheet of flexible material and thereby permitting the second free end of the sheet of flexible material to move upwardly.

One advantage of the present invention is that the upward resistive force exerted on the exerciser by the sheet of flexible material is in response to the force which the exerciser chooses to exert downwardly on the sheet of flexible material. Thus, the exerciser controls the desired amount of resistance generated by the apparatus, which in turn significantly minimizes the risk of injury associated with straining against relatively large, fixed opposing forces.

Other objects and advantages of the present invention will become apparent in view of the following detailed description and accompanying drawings.

DETAILED DESCRIPTION OF THE PREFERRED EMBODIMENTS

Figure 1:
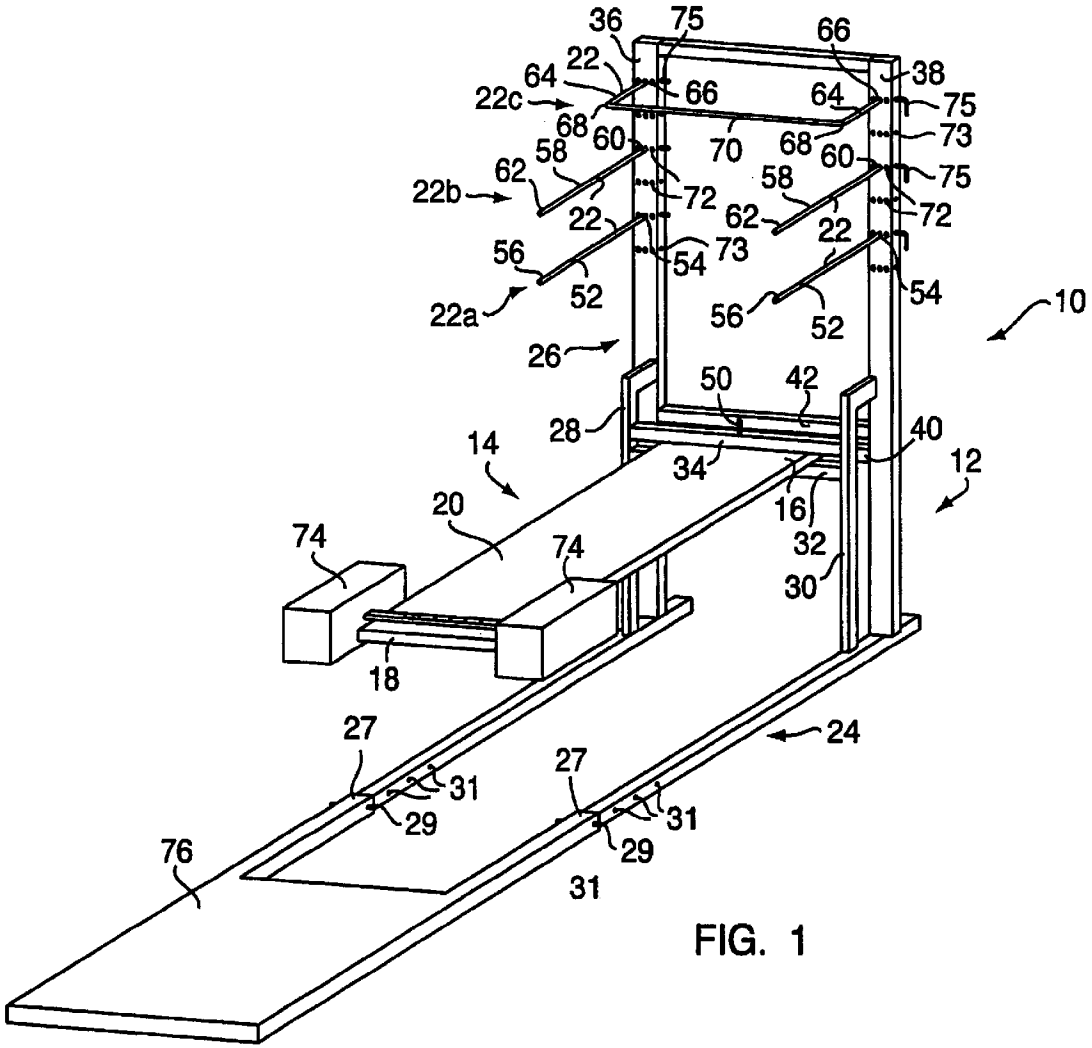
FIG. 1 is a front perspective view of an exercise apparatus embodying the present invention.
Figure 2:
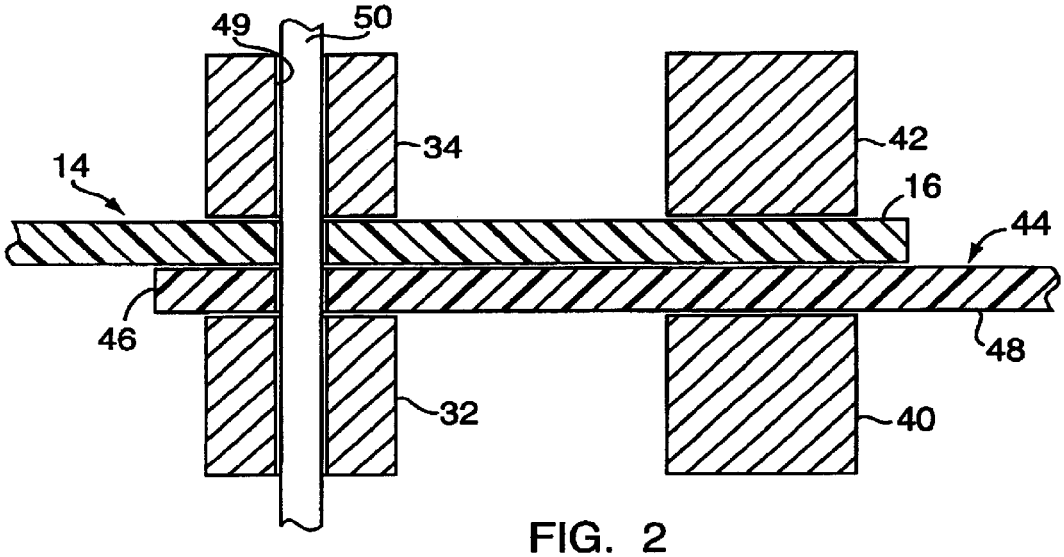
FIG. 2 is a partial, cross-sectional side elevational view of the exercise apparatus of FIG. 1.

With reference to FIGS. 1 and 2, an exercise apparatus embodying the present invention is indicated generally by the reference number 10. The apparatus 10 comprises a frame 12 fabricated from a strong rigid material such as, for example, two inch wide steel pipes or bars, at least one elongated sheet of flexible material 14, preferably rectangular in shape and having a first end 16 coupled to the frame at a height of about two feet from a lowest portion of the frame, and having a second free end 18 positioned frontwardly relative to the frame. The sheet of flexible material 14 has an upwardly facing support surface 20, and has a predetermined stiffness for supporting substantially the entire weight of an exerciser (not shown) of the apparatus upon the support surface 20. At least one support assembly 22 is mounted to the frame 12 and generally overhangs the support surface 20 of the sheet of flexible material 14 for further supporting the exerciser upon pushing downwardly against the sheet of flexible material and thereby moving the second free end 18 of the sheet of flexible material downwardly, and for supporting the exerciser upon pulling upwardly away from the sheet of flexible material to release the downward force against the sheet of flexible material and thereby permitting the second free end of the sheet of flexible material to move upwardly.

The sheet of flexible material 14 is preferably made of a polymeric material, such as polypropylene such as, for example, the "500 Series" stress relieved polypropylene sold under the trademark TROVIDUR by HPG, and defines a length of about 3 feet, a width of about 8 inches, and a thickness within the range of about ½ inch to 1½ inches. Increasing the width of the sheet material 14 increases its stiffness. For example, a sheet having a thickness of ½ inch supports an exerciser weighing about 100 lb., and a sheet having a thickness of ¾ inch supports an exerciser weighing about 150 lb. As will be recognized by those skilled in the pertinent art, the stiffness of the sheet may be increased by providing additional layers of sheet material.

In FIG. 1, the frame 12 comprises a base 24 having a length of preferably about five to six feet, and a standing assembly 26 having a height of preferably about six to eight feet. The base 24 may be assembled in sections such as by sliding one end of a section within the other at 27 and locking the sections by inserting pins 29 through holes 31 defined along at least a portion of the length of the sections. The standing assembly 26 includes a first set of standing members 28, 30 extending upwardly from the base 24 and spaced from one another at opposite sides of the frame 12. The spacing of the first set of standing members 28, 30 is preferably about two feet. First and second cross members 32, 34 each extend between the first set of standing members 28, 30. The second cross member 34 is positioned slightly higher (preferably two to three inches) on the frame 12 relative to the first cross member 32. The standing assembly 26 further includes a second set of standing members 36, 38 extending upwardly from the base 24 and spaced from one another, preferably about two feet, at opposite sides of the frame 12. Third and fourth cross members 40, 42 each extend between the second set of standing members 36, 38. The fourth cross member 42 is positioned slightly higher (preferably two to three inches) on the frame 12 relative to the third cross member 40, wherein the first end 16 of the sheet 14 is held by and interposed between the first and third cross members 32, 40 from below and the second and fourth cross members 34, 42 from above. The first and second standing members are coupled to one another by connecting members 41, 43 preferably at a height of about 2 to 3 feet above the base 24.

As shown in FIG. 2, an additional or second sheet 44 having a first end 46 and a second free end 48 may be provided. The first end 46 of the second sheet 44 is interposed between the first end 16 of the first sheet 14 and the first and third cross members 32, 40 of the frame 12. The second free end 48 of the second sheet 44 is positioned slightly rearwardly of the frame 12 such that the second sheet facilitates the dissipation of heat otherwise generated in the first sheet 14 from frictional engagement with the cross members when the first sheet is moved or flexed during an exercise operation.

Figure 3:
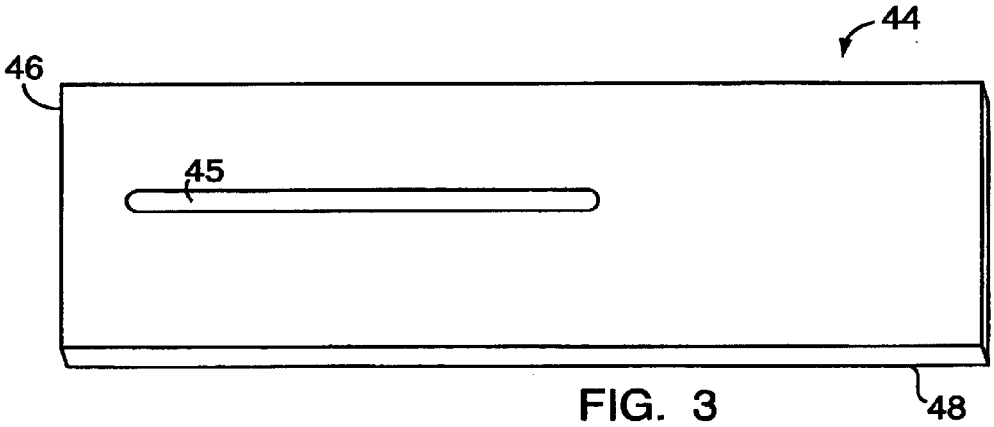
FIG. 3 is a plan view of a flexible sheet of the exercise apparatus in accordance with the present invention.

As best shown in FIG. 2, the first and second cross members 32, 34, and the first and second sheets 14, 44 cooperate to define a channel 49 vertically extending through the cross members 32, 34 and the sheets for receiving an elongated rigid member such as a bolt or pin 50 to secure the sheets to the frame 12. Preferably, as shown in FIG. 3, the second sheet 44 defines a slot 45 along at least part of its length for adjustably underlapping the first sheet 14 to adjust the stiffness of the sheets supporting the weight of the exerciser.

As shown in FIG. 1, the exercise apparatus 10 includes a first support assembly 22*a* mounted to the second set of standing members 36, 38 of the frame 12 for engaging the arms or legs of an exerciser while being supported on the sheet 14. The first support assembly 22*a* includes a first set of two elongated side members 52 located at a first predetermined height and at opposite sides of the frame 12. Each of the first set of two elongated side members 52 extends in a frontward direction relative to the second set of standing members 36, 38 of the frame 12 from a first end 54 adjacent to the frame to a second free end 56.

A second support assembly 22*b* may also be provided on the second set of standing members 36, 38 of the frame 12 and includes a second set of two elongated side members 58 located at a second predetermined height and at opposite sides of the frame 12. The second predetermined height is higher on the frame relative to the first predetermined height. Each of the second set of two elongated side members 58 extends in a frontward direction relative to the second set of standing members 36, 38 of the frame 12 from a first end 60 adjacent to the frame to a second free end 62.

A third support assembly 22*c* may also be provided on the second set of standing members 36, 38 of the frame 12 and includes a third set of two elongated side members 64 located at a third predetermined height and at opposite sides, of the frame 12. The third predetermined height is higher than the second predetermined height. Each of the third set of two elongated side members 64 extends in a frontward direction relative to the second set of standing members 36, 38 of the frame 12 from a first end 66 adjacent to the frame to a second end 68. A cross member 70 extends between the second ends 68 of the third set of two elongated side members 64.

An upper portion of the second set of standing members 36, 38 of the frame 12 preferably define a along its front and back surfaces a plurality of holes 72 spaced vertically from one another to receive the support assemblies at various heights on the frame. The holes may also be horizontally spaced from one another for receiving support assemblies of various widths to accommodate exercisers of different builds. As shown in FIG. 1, for example, the holes 72 are horizontally grouped in set of three. The upper portion of the second set of standing members 36, 38 of the frame 12 also preferably define along its side surfaces a plurality of holes 73 for receiving pins 75 into the holes 73 and corresponding holes (not shown) defined by the support assemblies in order to securely hold the support assemblies in place.

The exercise apparatus 10 preferably includes a pair of generally rigid pedals 74 pivotally attached to opposite sides of the sheet 14 adjacent to the second free end 18. Preferably, the pair of pedals 74 are attached for pivotal movement that is independent from one another. The pair of generally rigid pedals 74 preferably have planar upper and lower surfaces for standing upon the upper planar surfaces or applying leg presses to the lower planar surfaces such that the pivotal attachment of the rigid pedals to the sheet 14 permit the planar surfaces to remain in generally horizontal planes during movement of the sheet 14 during an exercise operation. Preferably, the pedals 74 are each 12 to 14 inches long, 3 to 4 inches wide, and 3 inches thick.

The base 24 of the exercise apparatus 10 may further include a stability member 76 disposed frontwardly of the standing members for underlying the back of an exerciser while performing an exercise operation involving leg presses on the sheet 14 to stabilize or prevent the exercise apparatus 10 from tipping.

In operation, the exerciser determines the thickness of the sheet 14 or the number of layers that has an adequate stiffness to support his or her weight. The sheet 14 is then inserted between the first and third cross members 32, 40 located below the sheet 14, and between the second and fourth cross members 34, 42 located above the sheet 14. As shown in FIG. 2, a second sheet 44 may be interposed between the sheet 14 and the first and third cross members 32, 40 to minimize the dissipation of heat through the sheet 14 caused by frictional engagement between the sheet 14 and the cross members during movement or flexing of the sheet during an exercise routine.

A pin 50, bolt or the like is inserted through the channel 49 formed by the first and second sheets 14, 44, and the first and second cross members 32, 34 to securely hold the sheets in place. The exerciser may then adjust one or more of the first, second and third support assemblies 22*a*, 22*b*, 22*c* at an appropriate height by choosing the vertically-spaced holes 72 to receive the side members 52, 58 and 68 of the first, second and third support assemblies, respectively.

The exerciser can stand on the pedals 74 facing the standing assembly 26. As the exerciser places his or her weight on the sheet 14, the sheet flexes or moves slightly downwardly. While in a standing position, the exerciser then grips the side members 52 of the first support assembly 22*a*, or grips the side members 58 of the second support assembly 22*b*, or grips the cross member 70 of the third support assembly 22*c*. The exerciser then performs repetitive isometric exercises by using the support assembly to push downwardly against the sheet of flexible material 14 and to pull upwardly away from the sheet of flexible material.

When pulling upwardly, the sheet 14 already flexed by the exerciser's weight releases a restorative force that aids the exerciser in the upward motion. As the exerciser pulls upwardly, the restorative force aids the exerciser in the upward movement so as to minimize the risk of injury to the exerciser from pulling up against his or her entire weight. However, as the exerciser pulls himself or herself upwardly, the restorative force progressively decreases such that the exerciser must exert an increasing force in order to pull him or herself further upwardly. When pushing downwardly against the support assembly, the second free end 18 of the first sheet 14 flexes downwardly. As the sheet 14 becomes increasingly flexed downwardly, the sheet provides an increasing resistive force. Thus, the exerciser can choose the level of the resistive force by choosing how far to push downwardly against the sheet 14 or to pull upwardly away from the sheet. By choosing the level of the resistive force or the restorative force, the exerciser minimizes the risk of injury compared with conventional exercise apparatus that offer fixed resistive or restorative forces.

Moreover, the exerciser can lie on the floor with his or her back covering and against the stability member 76 of the base 24 to perform leg presses against the sheet 14. The exerciser then engages the pedals 74 with his or her feet to perform repetitive isometric exercises by pressing upwardly against the pedals to of the apparatus 10 to generate an increasingly resistive force within the sheet and to thereafter release the resistive force by moving his or her feet downwardly. By choosing how much the sheet is flexed upwardly, the exerciser chooses the amount of resistive force to apply to his or her legs, thereby minimizing the risk of injury which can otherwise be caused by the misuse of conventional leg press devices which use fixed resistive forces.

As will be recognized by those of ordinary skill in the pertinent art, numerous modifications and substitutions may be made to the above-described and other embodiments of the present invention without departing from the scope of the invention as set forth in the appended claims. For example, the polypropylene sheet material may be substituted by other flexible materials, such as sheet metal or another type of polymeric material. Accordingly, the preceding portion of this specification is to be taken in an illustrative, as opposed to a limiting sense.

What is claimed:

1. An exercise apparatus comprising:

a frame;

at least one elongated sheet of flexible material having a first end coupled to the frame and having an unsupported second free end positioned frontwardly relative to the frame, the sheet of flexible material having an upwardly facing support surface, and the sheet of flexible material having a predetermined stiffness for supporting substantially the entire weight of an exerciser of the apparatus; and at least one support assembly mounted to an upper portion of the frame and generally overhanging the support surface of the sheet of flexible material, the at least one support assembly adapted to support the exerciser upon pushing downwardly against the sheet of flexible material to move the second free end of the sheet of flexible material downwardly, and the at least one support assembly adapted to support the exerciser upon pulling upwardly away from the sheet of flexible material to release the downward force against the sheet of flexible material and thereby permitting the second free end of the sheet of flexible material to move upwardly.

2. An exercise apparatus as defined in claim 1, wherein the at least one elongated sheet of flexible material is generally rectangular in shape.

3. An exercise apparatus as defined in claim 2, wherein the generally rectangular sheet of flexible material is from about ½ inches thick to about 1½ inches thick.

4. An exercise apparatus as defined in claim 2, wherein the generally rectangular sheet of flexible material is about 8 inches wide.

5. An exercise apparatus as defined in claim 2, wherein the generally rectangular sheet of flexible material is about 3 feet long.

6. An exercise apparatus as defined in claim 1, wherein the at least one elongated sheet of flexible material is polypropylene.

7. An exercise apparatus comprising:

a frame;

at least one elongated sheet of flexible material having a first end coupled to the frame and having a second free end positioned frontwardly relative to the frame, the sheet of flexible material having an upwardly facing support surface, and the sheet of flexible material having a predetermined stiffness for supporting substantially the entire weight of an exerciser of the apparatus;

at least one support assembly mounted to an upper portion of the frame and generally overhanging the support surface of the sheet of flexible material, the at least one support assembly adapted to support the exerciser upon pushing downwardly against the sheet of flexible material to move the second free end of the sheet of flexible material downwardly, and the at least one support assembly adapted to support the exerciser upon pulling upwardly away from the sheet of flexible material to release the downward force against the sheet of flexible material and thereby permitting the second free end of the sheet of flexible material to move upwardly; and a pair of generally rigid pedals pivotally attached to opposite sides of the elongated sheet of flexible material, the pair of generally rigid pedals having planar upper and lower surfaces for standing upon the upper planar surfaces or applying leg presses to the lower planar surfaces such that the pivotal attachment of the rigid pedals to the flexible sheet material permit the planar surfaces to remain in generally horizontal planes during movement of the elongated sheet of flexible material.

8. An exercise apparatus as defined in claim 7, wherein the pair of generally rigid pedals are independently pivotally attached to the elongated sheet of flexible material.

9. An exercise apparatus comprising:

a frame;

at least one elongated sheet of flexible material having a first end coupled to the frame and having a second free end positioned frontwardly relative to the frame, the sheet of flexible material having an upwardly facing support surface, and the sheet of flexible material having a predetermined stiffness for supporting substantially the entire weight of an exerciser of the apparatus; and at least one support assembly mounted to an upper portion of the frame and generally overhanging the support surface of the sheet of flexible material, the at least one support assembly adapted to support the exerciser upon pushing downwardly against the sheet of flexible material to move the second free end of the sheet of flexible material downwardly, the at least one support assembly adapted to support the exerciser upon pulling upwardly away from the sheet of flexible material to release the downward force against the sheet of flexible material and thereby permitting the second free end of the sheet of flexible material to move upwardly, and wherein the at least one support assembly includes two elongated side members located at a predetermined height and at opposite sides of the frame, each of the two elongated side members extending in a frontward direction relative to the frame from a first end adjacent to the frame to a second free end.

10. An exercise apparatus comprising:

a frame;

at least one elongated sheet of flexable material having a first end coupled to the frame and having an unsupported second free end positioned frontwardly relative to the frame, the sheet of flexible material having an upwardly facing support surface, and the sheet of flexible material having a predetermined stiffness for supporting substantially the entire weight of an exerciser of the apparatus; and at least one support assembly mounted to an upper portion of the frame and generally overhanging the support surface of the sheet of flexible material, the at least one support assembly adapted to support the exerciser upon pushing downwardly against the sheet of flexible material to move the second free end of the sheet of flexible material downwardly, the at least one support assembly adapted to support the exerciser upon pulling upwardly away from the sheet of flexible material to release the downward force against the sheet of flexible material and thereby permitting the second free end of the sheet of flexible material to move upwardly, and wherein the at least one support assembly includes:

a first support assembly including a first set of two elongated side members located at a first predetermined height and at opposite sides of the frame, each of the first set of two elongated side members extending in a frontward direction relative to the frame from a first end adjacent to the frame to a second free end;

a second support assembly Including a second set of two elongated side members located at a second predetermined height and at opposite sides of the frame, the second predetermined height being higher than the first predetermined height, each of the second set of two elongated side members extending in a frontward direction relative to the frame from a first end adjacent to the frame to a second free end; and a third support assembly including a third set of two elongated side members located at a third predetermined height and at opposite sides of the frame, the third predetermined height being higher than the second predetermined height, each of the third set of two elongated side members extending in a frontward direction relative to the frame from a first end adjacent to the frame to a second end, and a cross member extending between the second ends of the third set of two elongated side members.

11. An exercise apparatus comprising:

a frame;

at least one elongated sheet of flexable material having a first end coupled to the frame and having an unsupported second free end positioned frontwardly relative to the frame, the sheet of flexible material having an upwardly facing support surface, and the sheet of flexible material having a predetermined stiffness for supporting substantially the entire weight of an exerciser of the apparatus; and at least one support assembly mounted to an upper portion of the frame and generally overhanging the support surface of the sheet of flexible material, the at least one support assembly adapted to support the exerciser upon pushing downwardly against the sheet of flexible material to move the second free end of the sheet of flexible material downwardly, and the at least one support assembly adapted to support the exerciser upon pulling upwardly away from the sheet of flexible material to release the downward force against the sheet of flexible material and thereby permitting the second free end of the sheet of flexible material to move upwardly, and wherein the frame includes:

a base;

a first set of standing members extending upwardly from the base and spaced from one another at opposite sides of the frame, and first and second cross members each extending between the first set of standing members, the second cross member being positioned slightly higher relative to the first cross member; and a second set of standing members extending upwardly from the base, the second set of standing members being spaced from one another at opposite sides of the frame and disposed rearwardly of the first set of standing members, and third and fourth a-ass members each extending between the second set of starting members, the fourth cross member being positioned slightly higher relative to the third cross member, wherein the first end of the at least one elongated sheet of flexible material is held by and interposed between the first and third cross members from below and the second and fourth cross members from above.

12. An exercise apparatus as defined in claim 11, wherein the at least one elongated sheet of flexible material defines a hole extending therethrough adjacent to the first end, and at least one of the cross members defines a hole extending therethrough, and further including an elongated rigid member for being received though the holes to secure the at least one elongated sheet of flexible material to the frame.

13. An exercise apparatus as defined in claim 11, wherein the at least one elongated sheet of flexible material is a first sheet, and further including a second sheet having a first end and a second free end, the first end of the second sheet being interposed between the first end of the first sheet and the first and third cross members of the frame, and the second free end of the second sheet being positioned rearwardly of the frame such that the second sheet facilitates the dissipation of heat otherwise generated in the first sheet from frictional engagement with the cross members when the first sheet is moved during an exercise operation.

14. An exercise apparatus as defined in claim 11, wherein the base includes a stability member disposed frontwardly of the standing members for underlying the back of an exerciser when performing an exercise operation involving leg presses on the at least one elongated sheet of material to stabilize the exercise apparatus.

* * * * *